US005388270A

United States Patent [19]

Hewitt

[11] Patent Number: 5,388,270

[45] Date of Patent: Feb. 14, 1995

[54] FIREFIGHTER'S COAT INCLUDING DETACHABLE THERMAL WRIST SYSTEM

[75] Inventor: Joyce A. Hewitt, Alton, N.H.

[73] Assignee: Globe Manufacturing Company, Pittsfield, N.H.

[21] Appl. No.: 35,970

[22] Filed: Mar. 23, 1993

[51] Int. Cl.[6] ..... A41D 1/00

[52] U.S. Cl. ..... 2/93; 2/81; 2/82; 2/85; 2/97; 2/270

[58] Field of Search ..... 2/93, 81, 82, 87, 85, 2/97, 123, 126, 86, 270

[56] References Cited

U.S. PATENT DOCUMENTS

| | | | |
|---|---|---|---|
| 4,543,670 | 10/1985 | Ehring | 2/85 |
| 4,631,753 | 12/1986 | Ehring | 2/85 |
| 4,768,233 | 9/1988 | Grilliot et al. | 2/93 |
| 4,782,534 | 11/1988 | Grilliot et al. | 2/81 |
| 4,999,850 | 3/1991 | Grilliot et al. | 2/93 |
| 5,189,737 | 3/1993 | Ribicic | 2/93 |
| 5,208,919 | 5/1993 | Fields | 2/82 |

OTHER PUBLICATIONS

Gershman, Maurice, M.D., "Self-Adhering Nylon Tapes" *Journal of The American Medical Association, vol. 168, No. 7, p. 930.*

*Primary Examiner*—Clifford D. Crowder
*Assistant Examiner*—Gloria Hale
*Attorney, Agent, or Firm*—Watson, Cole, Grindle & Watson

[57] ABSTRACT

A liner sleeve is disposed within a shell sleeve, and a wrister is permanently and inseparably secured directly to the open lower end of a liner sleeve by stitching which extends along the liner sleeve to connect the wrister and liner circumferentially so that undesired material cannot enter between the wrister and the liner sleeve. A sleeve well is defined by a first annular member secured to a shell sleeve and a second annular member secured to a liner sleeve. The first and second annular members have annular arrays of interengaging hooks and loops and also interengaging diametrically opposite snap connectors for detachably connecting the annular members to one another. A further annular band of material disposed between the shell sleeve and the first annular member is formed of thermal protective moisture barrier material.

10 Claims, 2 Drawing Sheets

10
12
24
30
30'
32
32'
36
38
4
26
28
54
58
62
40
42
50
52
56
60
70
72
74
75
76
82
84
86
90
92
94
96
100
102
5

FIREFIGHTER'S COAT INCLUDING DETACHABLE THERMAL WRIST SYSTEM

BACKGROUND OF THE INVENTION

The present invention relates to firefighter's coats, and more particularly to a firefighter coat having a novel thermal wrist system which includes parts that are detachably connected to one another.

Firefighter's coats include an outer shell designed primarily to resist burning or charring when exposed to flames along with a liner which fits within the outer shell and which is designed to serve as a moisture barrier and to provide thermal insulation. The outer shell has a pair of open ended sleeves, and the liner has a pair of open ended sleeves which fit within the sleeves of the shell. A sleeve well or water well is formed at the lower end of the sleeves in firefighter's coats.

In addition, wristers are provided within the lower ends of the sleeves of the shell and are adapted to receive the wrists of the firefighter. Such wristers also may receive a portion of the hand of the firefighter and cooperate with the aforementioned sleeve well or water well to prevent water and other hazardous elements from entering the sleeves when the arms of the firefighter are raised.

In prior art constructions, it is possible that a gap can occur between the liner sleeve and the shell cuff or between the liner sleeve and the wrister. If such a gap should occur, the integrity of the sleeve or water well is destroyed and the wrist construction is unacceptable. It is therefore necessary to provide a construction wherein such gaps are eliminated.

The liner should be washed regularly and separate from the shell, and accordingly, it is necessary to detach and reattach the liner relative to the shell from time to time. It is a principal purpose of the invention to provide an arrangement wherein the liner can be readily detached and reattached to the shell while enhancing the thermal protection or capacity of the lower portions of the sleeves.

SUMMARY OF THE INVENTION

The present invention provides a construction wherein there is no thermal gap between the cuff of the shell and the liner sleeve. Furthermore, the wristers of the coat are secured to the lower ends of the liner sleeves so that there is no possible break in protection between a wrister and the associated liner sleeve.

The sleeve well or water well at the lower end of each of the shell sleeves includes a first annular portion of flame resistant moisture barrier material which is secured to the lower end of the associated shell sleeve and which cooperates with a second annular portion secured to the lower end of the associated liner sleeve. The second annular portion is formed of material similar to that of the first annular portion. The first and second annular portions are detachably connected to one another so that the liner may be readily detached from and reattached to the outer shell when desired. When the annular portions are operatively connected to one another, they cooperate to provide the well at the bottom of the sleeve.

The detachable connecting means for connecting the two annular portions to one another includes a pair of annular strips of hook and loop connecting means such as VELCRO and a pair of diametrically opposite snap connectors, the snap connectors providing visible means to ensure that the liner sleeve is properly aligned with the shell sleeve to which it is connected.

DESCRIPTION OF THE PREFERRED EMBODIMENT

Figure 1:
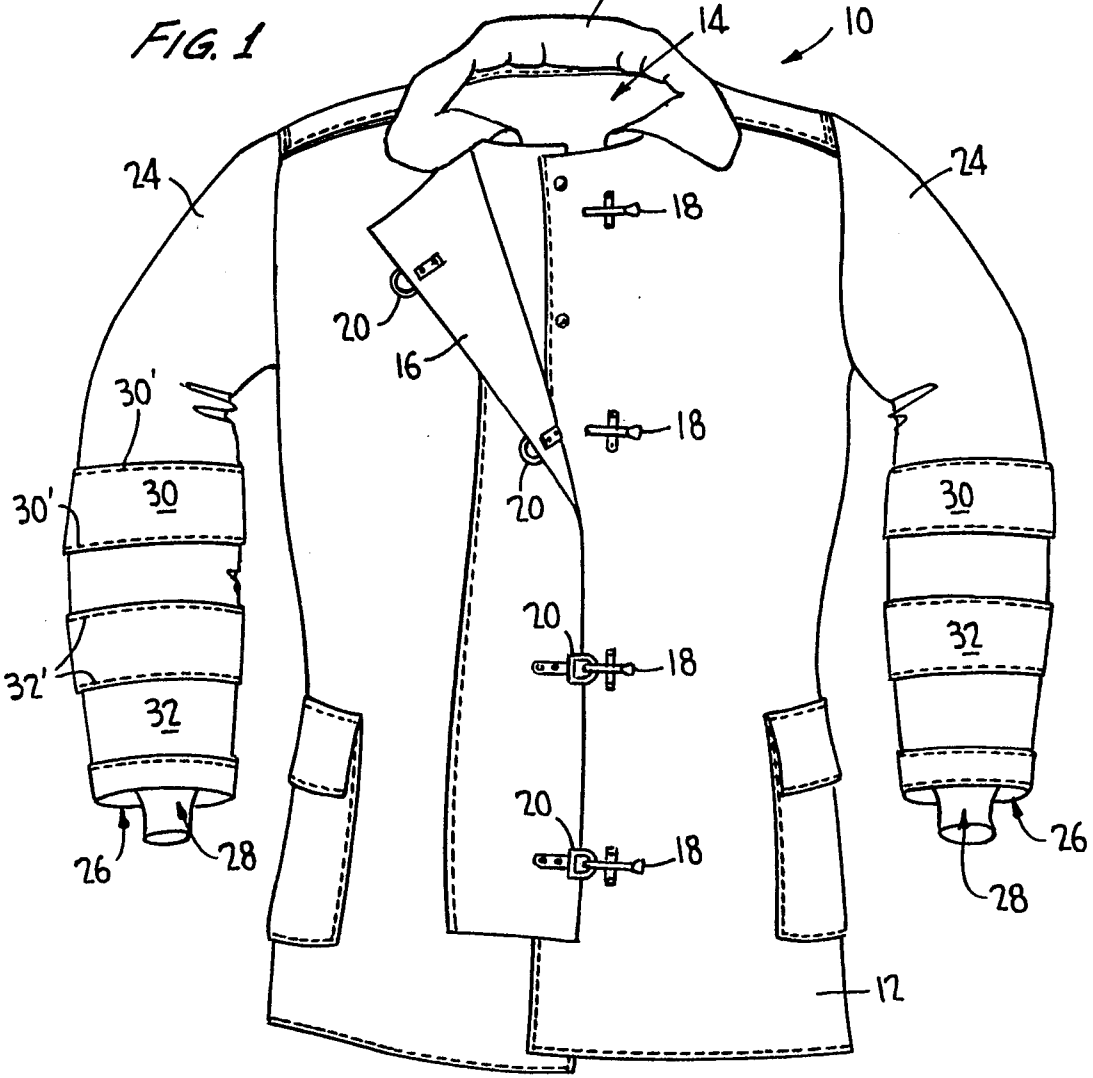
FIG. 1 is an elevation of a firefighter coat according to the invention.

Referring now to the drawings wherein like reference characters designate corresponding parts throughout the several views, there is shown in FIG. 1 a firefighter coat indicated generally by reference numeral 10 and being of conventional construction except for the thermal wrist system construction incorporated into the sleeves thereof hereinafter described in detail. The coat includes an outer shell 12 which may be made, for example, of an aramid fabric sold under the tradename NOMEX by F. E. dupont de Nemours & Co., Wilmington, Del., U.S.A. which is fire resistant and which has been treated or coated with a water repellent finish such as neoprene to provide water resistance.

The coat also includes an inner liner 14 having a conventional outer moisture barrier such as neoprene coated cotton material and a conventional inner heat insulating layer formed of NOMEX aramid fibers. The liner is detachably connected to the shell in a conventional manner by hook and loop fastener means such as VELCRO including a pair of interengaging strips of such material disposed along the length of the neck line on the collar facing. The liner is also secured by a plurality of snap fasteners to each coat facing in the usual manner. The conventional means for connecting the ends of the sleeves of the liner to the shell is replaced by the novel thermal wrist system of the invention.

The coat includes an outside storm flap 16, and a plurality of hook fasteners 18 cooperate with D-ring fasteners 20 for holding the coat in closed position. A collar 22 is provided, and a pair of sleeves 24 depend from the upper side portions of the coat, each of the sleeves terminating in an open lower end 26 having wristers 28 extending therefrom. The sleeves are of conventional construction except for the thermal wrist system at the lower end thereof. Light reflective horizontal bands 30 and 32 are stitched to each sleeve by lines of stitching 30' and 32' respectively. These bands may be, for example, formed of SCOTCHLITE material sold by 3-M Corp., Minneapolis, Minn., U.S.A.

Figure 6:
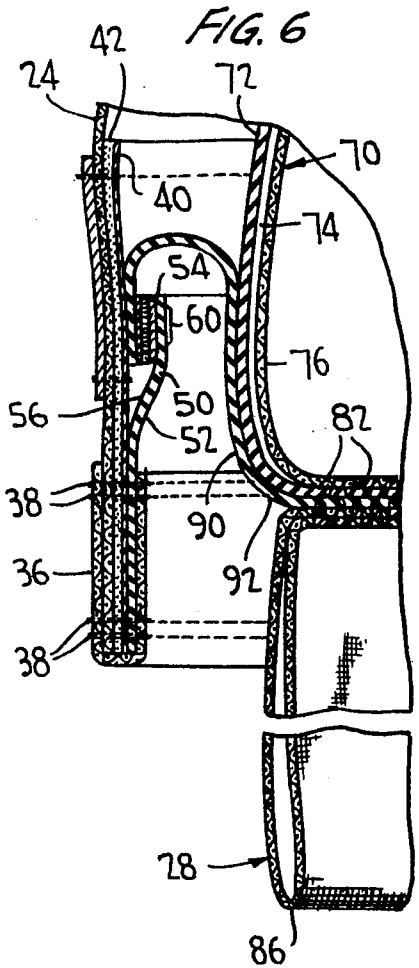
FIG. 6 is an enlarged sectional view showing the components connected to one another to form a sleeve well or water well.
Figures 2, 3, 4, 5:
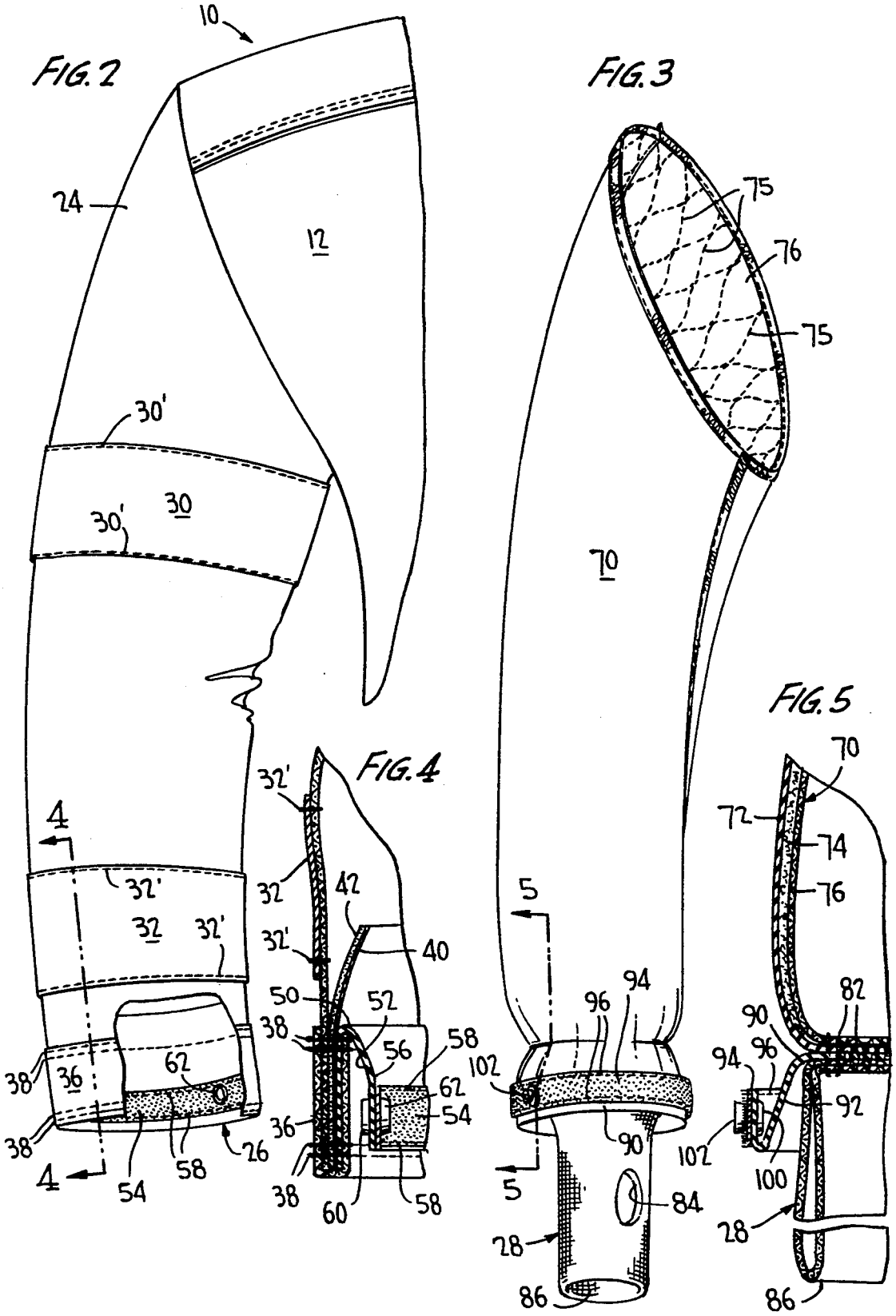
FIG. 2 is an enlarged view of one sleeve of the coat illustrated in FIG. 1 partly broken away and shown in the position for connecting it to a liner sleeve.
FIG. 3 is a view of one sleeve of the liner shown in the position for connecting it to a shell sleeve.
FIG. 4 is an enlarged sectional view taken along line 4—4 of FIG. 2.
FIG. 5 is an enlarged sectional view taken along line 5—5 of FIG. 3.

Referring now to FIGS. 2, 4 and 6, the sleeve cuff is reinforced with an extra layer 36 of outer shell material which may have a width of not less than about two inches and which is folded in half with approximately one-half thereof inside and one-half outside the sleeve to provide abrasion resistance. The cuff reinforcement is stitched to the the sleeve end with four rows of stitching 38.

An elongated annular portion 40 having a width of about three inches is disposed against the inner surface of shell sleeve 24 to serve as a moisture barrier and to provide enhanced thermal protection. Portion 40 is formed of ARAFILL material sold by Southern Mills, Union City, Ga. ARAFILL is a filler material which provides thermal insulation, and portion 40 is coated on one side 42 thereof with neoprene to provide a moisture barrier. Portion 40 is held in place by the lines of stitching 38.

An elongated annular portion 50 having a width of about three inches is sandwiched between portion 40 and the part of layer 36 which is disposed inside the sleeve. Annular portion 50 is held in place by the lines of stitching 38. Portion 50 may be formed of the same material as the outer moisture barrier of the liner comprising a cotton material which has a coating of neoprene on one side 52 thereof, i.e. on the side facing the wrist of a firefighter when in use.

An elongated annular strip of hook and loop connecting means 54 having a width of about one inch is disposed on portion 50 on the side 56 thereof which is opposite to side 52. Means 54 is secured in place by two lines of stitching 58. A pair of diametrically opposite snap fasteners 60 are secured to portion 50 and have female portions 62 thereof facing away from surface 56 thereof.

Referring now to FIGS. 3, 5 and 6, a sleeve 70 of the liner is shown, this sleeve being disposed within sleeve 24 of the outer shell when the coat is in use. The sleeve includes an outer moisture barrier 72 formed of neoprene coated cotton material. A layer of NOMEX aramid fibers 74 is quilted by stitching 75 to a facecloth 76 in a conventional manner.

A wrister 28 formed of knitted elasticized NOMEX material is secured to the lower open end of the sleeve 70 by an annular band of stitching 82. The wrister is a hand and wrist guard not less than six inches in length and of double thickness. A thumbhole 84 having a diameter of about two inches is formed in the wrister about one inch from the leading edge 86 of the wrister.

An elongated annular portion 90 having a width of about three inches has the inner edge thereof sandwiched between the lower end of the the sleeve 70 and the wrister 28 and is held in place by the annular band of stitching 82 which passes therethrough. Portion 90 is formed of the same material as portion 50 including a coating of neoprene on one side 92 thereof, or on the side facing side 52 of portion 50 when in use as shown in FIG. 6.

An elongated annular strip of hook and loop connecting means 94 having a width of about one inch is secured to the edge of portion 90 on side 92 thereof by two lines of stitching 96. A pair of diametrically opposite snap fasteners 100 are secured to portion 50 and have male portions 102 thereof facing away from surface 92 thereof. Only one of snap fasteners 100 is visible in the drawings.

When it is desired to assemble the liner within the shell, the liner is inserted within the coat so that the sleeves of the liner are disposed within the sleeves of the coat, and the liner is fastened to the coat at the collar facing and the coat facings of the shell as described above. The thermal wrist system of the shell sleeve and liner sleeve is then folded into the positions shown in FIGS. 2–5 so that the hook and loop connector means 54 on the shell sleeve is in facing relationship with the hook and loop connector means 94 of the liner sleeve, with snap fasteners 60 and 100 on the sleeves of the shell and liner respectively disposed adjacent one another.

The snap fasteners are snapped together to properly align and interconnect the shell sleeve and liner sleeve. The hook and loop connector means 54 and 94 are pressed together throughout the length thereof to form an annular connecting means extending completely around the liner sleeve. The components are then folded into the final operative position as shown in FIG. 6 to form a sleeve or water well at the bottom of each sleeve. The neoprene coated surfaces 52 and 92 are disposed in facing relationship to one another and provide an effective moisture barrier and also prevent other hazardous elements from entering the sleeves when the arms are raised. Since the wristers are permanently secured to the lower ends of the liner sleeves, there is no possibility of undesired material entering between the wrister and the liner sleeve. Portion 40 provides further protection adjacent the sleeve sell or water well.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A firefighter coat including an outer shell having a pair of shell sleeves each of which has an open lower end, a liner within said outer shell and having a pair of liner sleeves each of which has an open lower end, each of said liner sleeves being disposed within one of said shell sleeves, a pair of wristers, each of said wristers being permanently and inseparably secured by stitching directly to the open lower end of one of said liner sleeves, said stitching extending along the open lower end of the associated liner sleeve to connect said wrister and said liner sleeve circumferentially so that each wrister cannot move away from the associated liner sleeve and there is no possibility of undesired material entering between each wrister and the associated liner sleeve at any time, and means detachably connecting the lower end of each liner sleeve and the interconnected wrister to the lower end of the associated shell sleeve to form a sleeve well at the lower end of each of said shell sleeves.

2. A firefighter coat including an outer shell having a pair of shell sleeves each of which has an open lower end, a liner within said outer shell and having a pair of liner sleeves each of which has an open lower end, each of said liner sleeves being disposed within one of said shell sleeves, a pair of wristers, each of said wristers being directly permanently and inseparably secured to the open lower end of one of said liner sleeves by an annular band of stitching so that each wrister cannot move away from the associated liner sleeve and there is no possibility of undesired material entering between each wrister and the associated liner sleeve at any time, a sleeve well at the lower end of each of said shell sleeves, each sleeve well including a first elongated portion of flame resistant moisture barrier material secured to the lower end of an associated shell sleeve and a second elongated portion of flame resistant moisture barrier material secured to the lower end of an associated liner sleeve, and connecting means for detachably connecting said first elongated portion to said second elongated portion.

3. A coat as defined in claim 2 wherein said first and second elongated portions are each of annular configuration.

4. A coat as defined in claim 2 wherein said connecting means is of annular configuration.

5. A coat as defined in claim 2 wherein said connecting means includes interengaging hooks and loops.

6. A coat as defined in claim 2 wherein said connecting means includes a pair of spaced snap connectors.

7. A coat as defined in claim 2 wherein said first and second elongated portions are each of annular configuration, said connecting means comprising a pair of diametrically opposite snap connectors.

8. A coat as defined in claim 2 wherein said connecting means includes a pair of cooperating annular bands of hook and loop material, each annular band being secured to one of said elongated portions.

9. A firefighter coat including an outer shell having a pair of shell sleeves each of which has an open lower end, a liner within said outer shell and having a pair of liner sleeves each of which has an open lower end, each of said liner sleeves being disposed within one of said shell sleeves, a pair of wristers, each of said wristers being secured to the lower end of one of said liner sleeves, a sleeve well at the lower end of each of said shell sleeves, each sleeve well including a first elongated portion of flame resistant moisture barrier material secured to the lower end of an associated shell sleeve and a second elongated portion of flame resistant moisture barrier material secured to the lower end of an associated liner sleeve, and connecting means for detachably connecting said first elongated portion to said second elongated portion, said coat including a further elongated portion secured to the lower end of each shell sleeve and disposed between the associated shell sleeve and the associated first elongated portion, said further elongated portion being formed of a thermal protective moisture barrier material.

10. A coat as defined in claim 9 wherein said further elongated portion comprises an annular band of material.

* * * * *